US011712064B2

(12) United States Patent
Bouchuiguir et al.

(10) Patent No.: US 11,712,064 B2
(45) Date of Patent: Aug. 1, 2023

(54) HEATING ASSEMBLY FOR A VAPOUR GENERATING DEVICE

(71) Applicant: JT International S.A., Geneva (CH)

(72) Inventors: Layth Sliman Bouchuiguir, Bellevue (CH); Manabu Yamada, Tokyo (JP); Philipp Hans Refior, Munich (DE)

(73) Assignee: JT International S.A.

( * ) Notice: Subject to any disclaimer, the term of this patent is extended or adjusted under 35 U.S.C. 154(b) by 502 days.

(21) Appl. No.: 16/767,194

(22) PCT Filed: Dec. 18, 2018

(86) PCT No.: PCT/EP2018/085472
§ 371 (c)(1),
(2) Date: May 27, 2020

(87) PCT Pub. No.: WO2019/121668
PCT Pub. Date: Jun. 27, 2019

(65) Prior Publication Data

US 2020/0390154 A1 Dec. 17, 2020

(30) Foreign Application Priority Data

Dec. 18, 2017 (EP) ..... 17208230

(51) Int. Cl.
*A24F 13/00* (2006.01)
*A24F 40/46* (2020.01)
(Continued)

(52) U.S. Cl.
CPC ..... *A24F 40/46* (2020.01); *A24F 40/60* (2020.01); *H05B 1/0202* (2013.01); *H05B 3/06* (2013.01); *A24F 40/20* (2020.01)

(58) Field of Classification Search
CPC ..... A24F 47/00
(Continued)

(56) References Cited

U.S. PATENT DOCUMENTS 5,144,962 A 9/1992 Counts et al.
2014/0217085 A1 8/2014 Alima
(Continued)

FOREIGN PATENT DOCUMENTS

CN 103997922 A 8/2014
GB 2534214 A 7/2016
(Continued)

OTHER PUBLICATIONS

International Search Report for PCT/EP2018/085472 dated Mar. 22, 2019; 3 pages.
(Continued)

*Primary Examiner* — Phuong K Dinh
(74) *Attorney, Agent, or Firm* — Lerner David LLP

(57) ABSTRACT

A heating assembly includes a body defining a heating compartment adapted to receive a vapour generating substance; at least two heaters between which the vapour generating substance is placeable within the heating compartment in use; a movement mechanism adapted in use to move at least one of the at least two heaters between a first and second position, the distance between the at least two heaters being less when the at least one heater is in the first position than when in the second position, wherein the distance between the at least two heaters when the at least one heater is in the first position being such that the separation of the at least two heaters applies pressure to the vapour generating substance when located in the heating compartment; and a switch adapted in use to control the movement of the at least one heater by the movement mechanism.

18 Claims, 8 Drawing Sheets

(51) Int. Cl.

| | |
|---|---|
| ***A24F 40/60*** | (2020.01) |
| ***H05B 1/02*** | (2006.01) |
| ***H05B 3/06*** | (2006.01) |
| *A24F 40/20* | (2020.01) |

(58) Field of Classification Search
USPC ..... 131/328–329
See application file for complete search history.

(56) References Cited

U.S. PATENT DOCUMENTS

| | | | | |
|---|---|---|---|---|
| 2014/0301721 | A1 | 10/2014 | Ruscio et al. | |
| 2015/0013696 | A1 | 1/2015 | Plojoux et al. | |
| 2016/0360794 | A1 | 12/2016 | Li et al. | |
| 2017/0303598 | A1 | 10/2017 | Li et al. | |
| 2022/0225669 | A1* | 7/2022 | Hawes | A24F 40/53 |

FOREIGN PATENT DOCUMENTS

| | | | |
|---|---|---|---|
| JP | H03232481 | A | 10/1991 |
| WO | 2016124550 | A1 | 8/2016 |

OTHER PUBLICATIONS

Search Report dated Sep. 26, 2022 from Office Action for Chinese Application No. 201880079449.8 dated Oct. 9, 2022. 3 pgs.

* cited by examiner

HEATING ASSEMBLY FOR A VAPOUR GENERATING DEVICE

CROSS-REFERENCE TO RELATED APPLICATIONS

The present application is a national phase entry under 35 U.S.C. § 371 of International Application No. PCT/EP2018/085472, filed Dec. 18, 2018, published in English, which claims priority to European Application No. 17208230.7 filed Dec. 18, 2017, the disclosures of which are incorporated herein by reference.

BACKGROUND OF THE INVENTION

The present invention relates to a heating assembly for a vapour generating device.

Devices which heat, rather than burn, a substance to produce a vapour for inhalation have become popular with consumers in recent years.

Such devices can use one of a number of different approaches to provide heat to the substance. One such approach is that of simple provision of a heating element to which electrical power is provided to heat the element, the element in turn heating the substance to generate vapour.

One way to achieve such heating is to provide a compartment in a device into which an end of a vapour generating consumable is able to be placed and then to apply heating to the vapour generating consumable using a heating element. This allows heating to be applied only when the vapour generating consumable is located in the heating compartment and therefore allows repeated and controlled vapour generation. However, the efficiency of the heating applied to the consumable is affected by any air gap between the consumable and heating element. As such, if a smaller size consumable is used the heating efficiency will be detrimentally effected.

A solution to this is to have compartment walls that press against the consumable, for example by means of a spring. However, this compression reduces the life span of the consumable.

The present invention seeks to address at least some of the above problems.

SUMMARY OF INVENTION

According to a first aspect, there is provided a heating assembly, comprising: a body defining a heating compartment adapted to receive a vapour generating substance; at least two heaters between which the vapour generating substance is placeable within the heating compartment in use; a movement mechanism adapted in use to move at least one of the at least two heaters between a first and second position, the distance between the at least two heaters being less when the at least one heater is in the first position than when in the second position, wherein the distance between the at least two heaters when the at least one heater is in the first position being such that the separation of the at least two heaters applies pressure to the vapour generating substance when located in the heating compartment; and a switch operable by a user of the assembly, the switch being adapted in use to control the movement of the at least one heater by the movement mechanism.

We have found that the application of pressure in this manner, namely the amount of pressure applied being determinable by the user operating the switch, prolongs the life of the vapour generating substance. This is because pressure is not applied continuously to the vapour generating substance and also allows different size vapour generating substances to be used without detrimentally affecting the heating efficiency. Accordingly heating efficiency is maintained when different size consumable vapour generating substances are used. The assembly according to the first aspect also allows easy user control of the heating being applied to the vapour generating substance without requiring the user to also control the amount of energy supplied the heaters.

The distance between the at least two heaters when the at least one heater is in the first position being such that the separation of the at least two heaters applies pressure to the vapour generating substance when located in the heating compartment is intended to mean that the separation of the at least two heaters is less than the width of the vapour generating substance between the at least two heaters. This would cause the vapour generating substance to be compressed when the at least one heater is in the first position. Put another way, when the at least one heater is in the first position, the separation between the at least two heaters may be such that the vapour generating substance may prohibited from entering the heating compartment if not already present in the heating compartment due to the size of the vapour generating substance relative to the separation between the at least two heaters. In this situation, it is assumed the vapour generating substance may be a cigarette or an object about the size and shape of a cigarette.

Each heater may provide at least part of a wall of the heating compartment.

The switch is operable by a user in any way, for example using their body such as a hand/finger or using tools such as a consumable. In the case where a user uses a consumable to operate switch, the switch may be inside of the heating compartment. Then when user inserts the consumable into the heating compartment, the switch is activated. The switch may be an optical sensor that detects the insertion or may be a pressure switch at the bottom of compartment to detect the pressure applied by the consumable.

The heaters may be active (i.e. operating so as to generate heat) at any time and may be activated by any trigger. Typically, the at least two heaters are adapted to activate on operation of the switch by the user. Preferably, the at least two heaters are adapted to only be activated when the switch is being operated by the user. This reduces energy wastage since heating is only applied when it is wanted.

Operation of the switch may cause the movement mechanism to move the at least one heater in any direction to or from any particular position. Typically, the switch is configured such that operation by a user causes the movement mechanism to move the at least one heater to the first position. This prolongs the life of the vapour generating substance since the user needs to take action for the distance between the heaters to be reduced and therefore for contact to be made with and/or pressure to be applied to the vapour generating substance instead of the vapour generating substance being compressed at all times. Preferably, the movement mechanism is configured to move the at least one heater to the first position only on operation of the switch by a user.

Alternatively, the switch may be configured such that operation by a user causes the movement mechanism to move the at least one heater to the second position, and preferably the movement mechanism is configured to move the at least one heater to the second position only on operation of the switch by a user. This allows pressure to be automatically applied to the vapour generating substance making it more simple for the user to adjust the amount of heating provided since operation of the switch causes the heating being applied to be reduced.

The switch may be located anywhere on the body of the assembly. Typically, the switch is located on a face of the body of the assembly having an opening in communication with the heating compartment, preferably the switch is positioned off-centre on said face. The surface with the opening will generally be considered to be the upper-most or top surface of the assembly due to how the assembly is intended to be used. Accordingly, locating the switch on this surface provides easy access to the switch for the user. The user is able to hold the device without causing the switch to operate while keeping the switch within easy reach and in a position the user will find comfortable and similar to other similarly shaped objects, such as a cigarette lighter.

Alternatively, the switch may be located on a surface of the body parallel to a longitudinal axis of the assembly. This allows the user to hold the assembly and operate the switch simultaneously. The switch is also able to be operated independently of the assembly being held, the position of the switch on this surface being convenient relative to the placement of the users hand when the user is holding an exposed end of the vapour generating substance in or near their mouth or face.

The switch may be any form of switch suitable to cause the movement mechanism to move the at least one heater between the first and second positions. Typically, the switch is operable over a switching range, the amount of operation of the switch over the switching range being configured to determine the amount of movement between the first and second positions applied to the at least one heater by the movement mechanism. This allows the user to more easily control the amount of pressure applied to the vapour generating substance since the user controls the amount of movement of the at least one heater between the two positions.

As mentioned above, the switch may by any suitable form of switch, such as a rotatory, linear, slide or toggle switch. Typically, the switch is a push switch, and preferably the amount of push applied to the switch may correspond to the amount of movement of the at least one heater by the movement mechanism. Of course this allows a push applied by the user to move the at least one heater towards or away from the first position by an amount proportional to the amount of push applied to the switch.

Preferably, pushing of the push switch may be configured to move the at least one heater towards the first position. This configuration may be such that the at least one heater only moves towards the first position in response to the push switch being pushed. This prolongs the life of the vapour generating substance by only applying pressure to the vapour generating substance when action is taken by a user instead of continuously applying pressure.

The switch may operate in any suitable manner. Typically, the switch has a bias to a position in which the at least one heater is held in the second position by the movement mechanism. This simplifies the configuration of the assembly by urging the at least one heater into the second position when the switch is not being operated. This allows a vapour generating substance to be placed into the heating compartment without needing any user interaction with the switch, which makes the assembly simpler to operate.

The movement mechanism may be any suitable form of mechanism capable of moving at least one of the at least two heaters. Preferably, the movement mechanism may be a sliding mechanism. This allows the at least one heater to be moved by sliding, for example along a rail or by movement of a piston.

The sliding mechanism may cause movement of the at least one heater on operation of the switch in any suitable manner. Typically, the sliding mechanism may be connected to each of the at least one heater and the switch. This allows interaction by the user with the switch to directly affect the movement mechanism and for the movement mechanism to provide a physical link between the switch and the at least one heater, which keeps the assembly configuration simple. Preferably, the switch and movement mechanism are a unitary component.

Of the at least two heaters, two or more heaters, or each heater may be moveable on operation of the switch. This may apply regardless of the movement mechanism used.

As an alternative to the movement mechanism being a sliding mechanism, the movement mechanism may be a hinge mechanism. This allows the amount of heat applied to the vapour generating substance to vary along the length of the vapour generating substance.

Preferably, the movement mechanism may be further adapted in use to move the at least one heater to a third position, the distance between the at least two heaters being less when in the third position than when in the first position. This allows access to the heating compartment to be blocked and also allows a lid to the heating compartment to be moved at the same time as the at least one heater to close or partially close the heating compartment.

The distance between the at least two heaters when in the third position may be any distance less than that when the at least two heaters are in the first position. Typically, the distance between the at least two heaters when in the third position is zero.

The at least two heaters may be in the third position at any suitable time. Typically, the at least one heater is in the third position when the switch is inactive. This allows access to the heating compartment to be blocked when the assembly is not in use.

According to a second aspect, there is provided a vapour generating device, comprising: a heating assembly according to any one of the preceding claims; and a vapour generating substance placeable within a heating compartment of the heating assembly. To be placeable within the heating compartment, the vapour generating substance may be shaped to fit into the heating compartment, such as by having the shape of a cigarette, or having dimensions that allow it to fit within the heating compartment.

BRIEF DESCRIPTION OF FIGURES

An example heating assembly is described in detail below, with reference to the accompanying figures, in which.

DETAILED DESCRIPTION

We now describe an example of a vapour generating device, including a description of a number of example heating assemblies and an example vapour generating substance.

Figure 1:
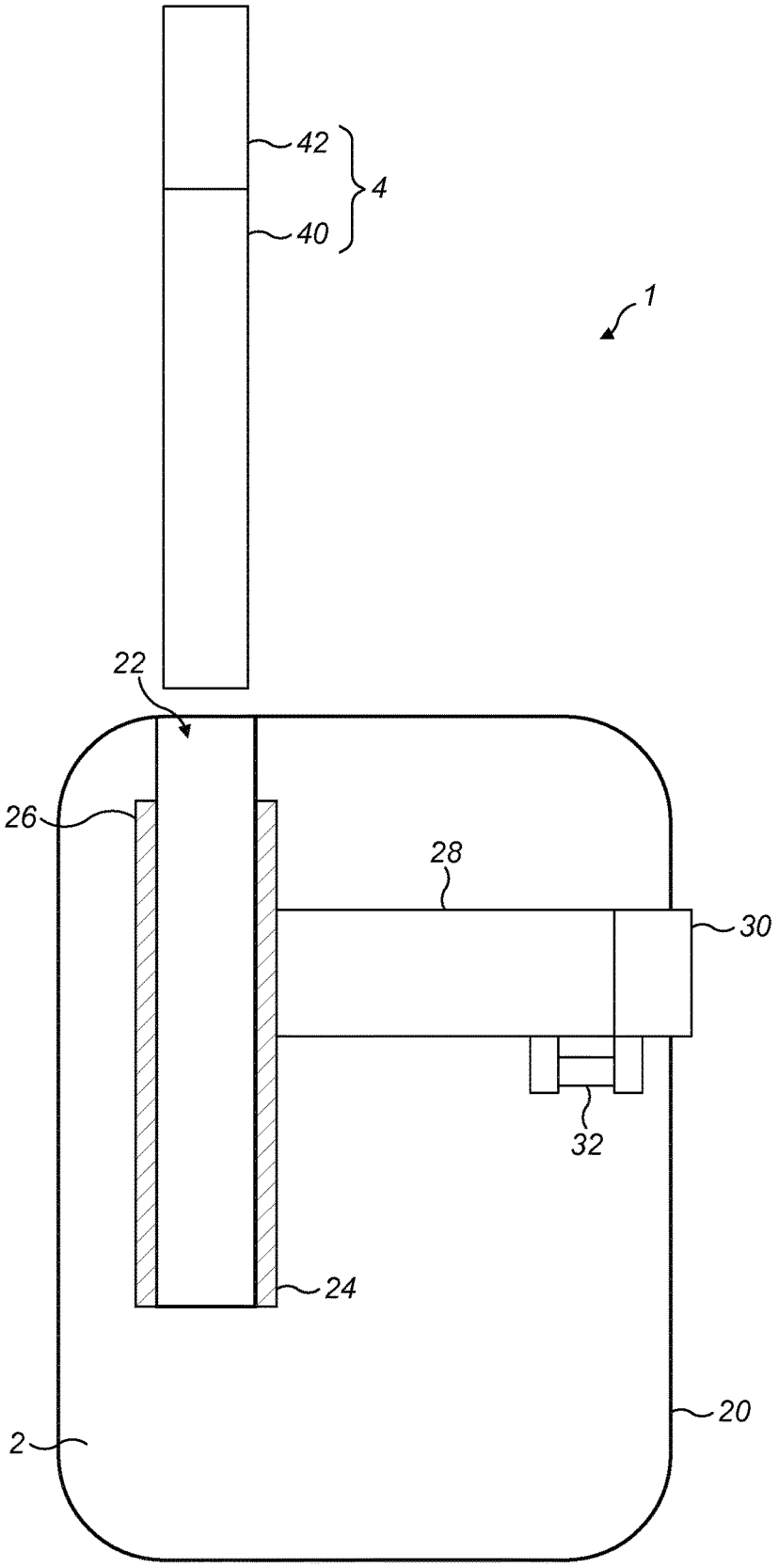
FIG. 1 shows an exploded view of an example vapour generating device.

Referring now to FIG. 1, an example vapour generating device is generally illustrated at 1. The example vapour generating device is a hand held device (by which we intend to mean a device that a user is able to hold and support un-aided in a single hand).

The example vapour generating device 1 is shown in FIG. 1 in a disassembled arrangement. This shows two parts of the vapour generating device, namely a heating assembly 2 and a vapour generating substance 4 in a separated arrangement.

The example heating assembly 2 shown in FIG. 1 has a body 20. The body has a bore in one surface (the upper-most surface shown in FIG. 1). The walls of the bore form a heating compartment 22 and the top of the bore defining an opening in the upper-most surface of the body of the heating assembly. The heating compartment has a complimentary shape to the vapour generating substance 4, which is described in more detail below. As such, in this example, the heating compartment is generally cylindrical in shape and is substantially longer than it is wide.

A first heating element 24 and second heating element 26 (also referred to hereafter as the first and second "heaters"), are located on the side walls of the heating compartment 22 (i.e. the walls that run parallel to the longitudinal axis of the heating compartment). The two heaters are located on opposing sides of the heating compartment and, in this example, extend from a base of the heating compartment along most of the length of the heating compartment so that only an end portion of the side walls is not formed by the heaters.

The first heater 24 is connected to a movement mechanism 28. The movement mechanism is also connected to a switch 30. The switch is located on a side of the body 20, the side being generally parallel to the longitudinal axis of the heating compartment 22.

In this example, the movement mechanism 28 provides linear movement by providing a sliding ability and the switch 30 is a push switch that is able to be depressed on operation by a user. The switch has a range over which it can be depressed, and is connected to a spring 32 that, in this example, urges the switch towards an un-depressed position, this un-depressed position causing the switch to protrude from the body. As such, as is set out in more detail below, in this example, when the switch is depressed due to operation by a user, the first heater 24 is caused to move laterally relative to the longitudinal axis of the heating compartment 22. This movement causes the first heater to move closer to the second heater 26.

Turning to the vapour generating substance 4, this is a consumable item (also referred to as a "heatstick"). The vapour generating substance has a tobacco rod 40, one end of which is attached to a filter 42 though which air and vapour can be drawn or can pass. The vapour generating substance has a shape similar to a conventional cigarette. As such, the tobacco rod and filter are generally cylindrical. In this example the tobacco rod has a length that corresponds to the length of the first and second heaters 24, 26 and the vapour generating substance has a width (and therefore diameter) that allows it to fit within the heating compartment 22 of the heating assembly 2. Of course, in other examples, other sizes of vapour generating substances may be used.

Figure 2:
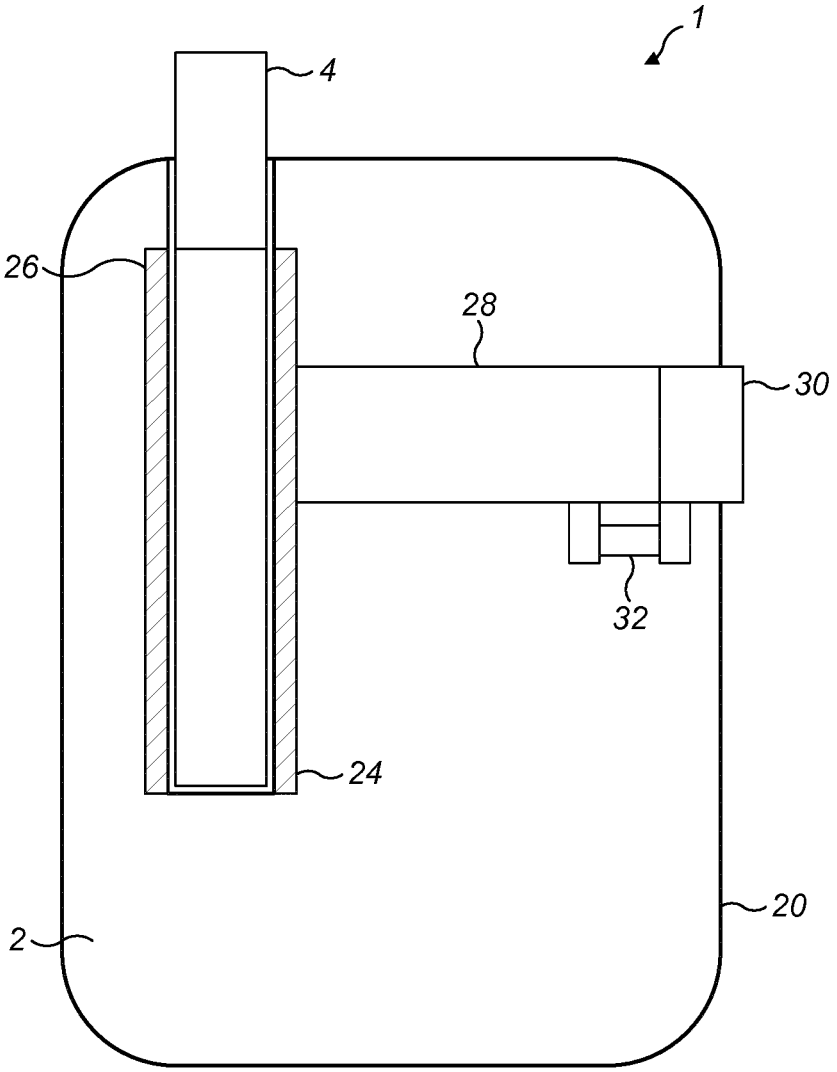
FIG. 2 shows a schematic view of the example vapour generating device shown in FIG. 1.
Figure 3:
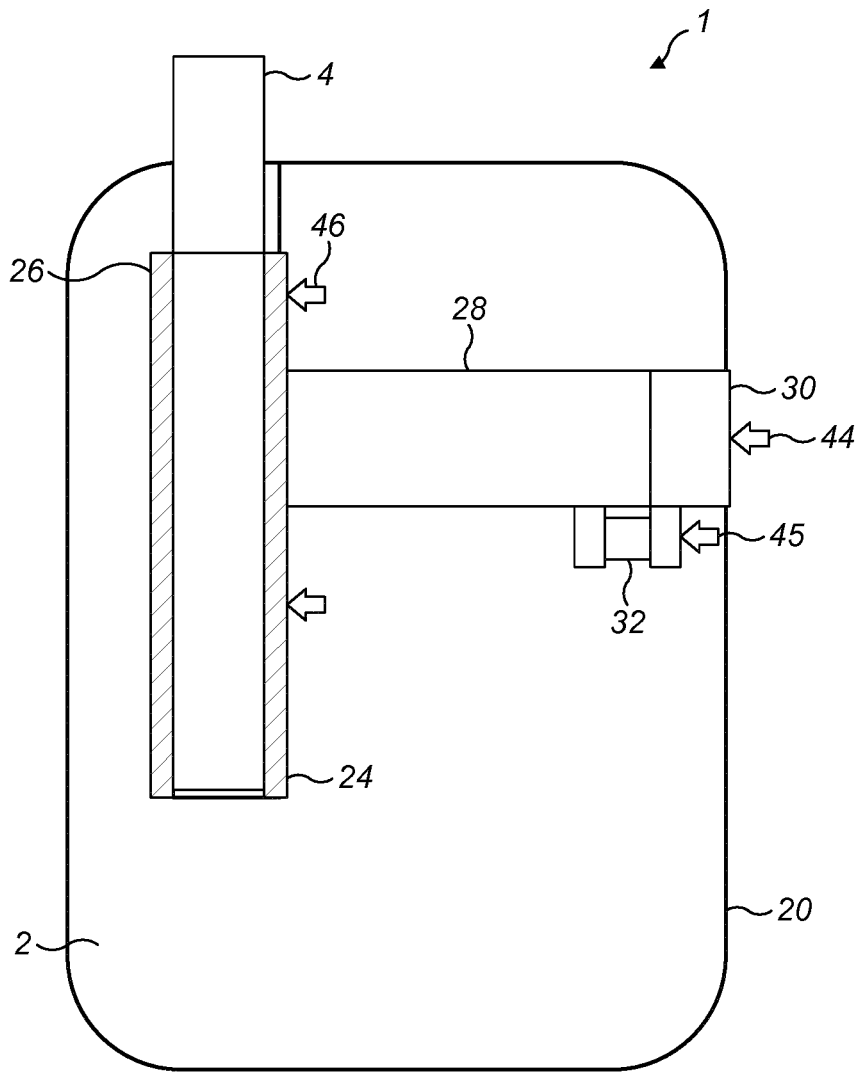
FIG. 3 shows a further schematic view of the example vapour generating device shown in FIG. 1.

A method of using the vapour generating device 1 shown in FIG. 1 is now described in reference to FIG. 2 and FIG. 3. In FIG. 2 the vapour generating substance 4 is placed in the heating compartment 22 of the heating assembly 2 with the filter 42 protruding from the heating compartment.

The switch 30 is in an un-depressed position in FIG. 2. This position is maintained by the spring 32. This is because the urging of the spring on the switch has not been overcome by a user pushing on the switch. This means that the first heater 24 is held by the movement mechanism 28 at the greatest possible distance from the second heater 26 for the range of movement permitted by the switch and movement mechanism. This position is referred to as the "second position".

In the second position, there is minimal contact between the heaters 24, 26 and the vapour generating substance 4. There may also be an air gap between one or both of the heaters and the vapour generating substance. Additionally, since the switch 30 is not being operated by a user, the heaters are not generating heat. As such, the vapour generating substance is not heated. This means that little or no vapour is generated.

When a user pushes the switch 30 (as indicated by arrow 44 in FIG. 3), the components are able to be moved to the positions shown in FIG. 3. In this figure the switch is shown in a depressed state. This has caused the switch to slide into the body 20 of the heating assembly against the action of the spring 32, which compresses the spring (as indicated by arrow 45 in FIG. 3). This in turn causes the movement mechanism 28 to slide laterally moving the first heater 24 into a position with a reduced distance to the second heater 26, which is indicated by arrow 46. This is referred to as the first position. In this position, the first and second heaters are in contact with the tobacco rod 40 of the vapour generating substance 4. The movement of the first heater also applies pressure and, in some examples, compression to the tobacco rod. This holds the vapour generating substance in place between the two heaters.

Depression of the switch causes the first heater and second heater to generate heat. This is achieved, for example, by the switch triggering a micro-switch when operated by a user. The heat warms the vapour generating substance causing it to generate vapour that is able to be drawn by a user through the filter 42 or that passes through the filter without being drawn by the user. The vapour is then able to be inhaled.

FIGS. 2 and 3 show the extremes of the range of motion of the first heater 24 achievable by a user operating the switch 30. The switch is able to be depressed to a lesser extent than shown in FIG. 3. This is because the switch is depressible continuously across a switching range. As such, the switch is able to be only partially depressed. This results in less pressure being applied to the tobacco rod 40. This also causes less heat to pass into the tobacco rod due to the tobacco rod being more loosely held between the first heater 24 and the second heater 26.

Figure 4:
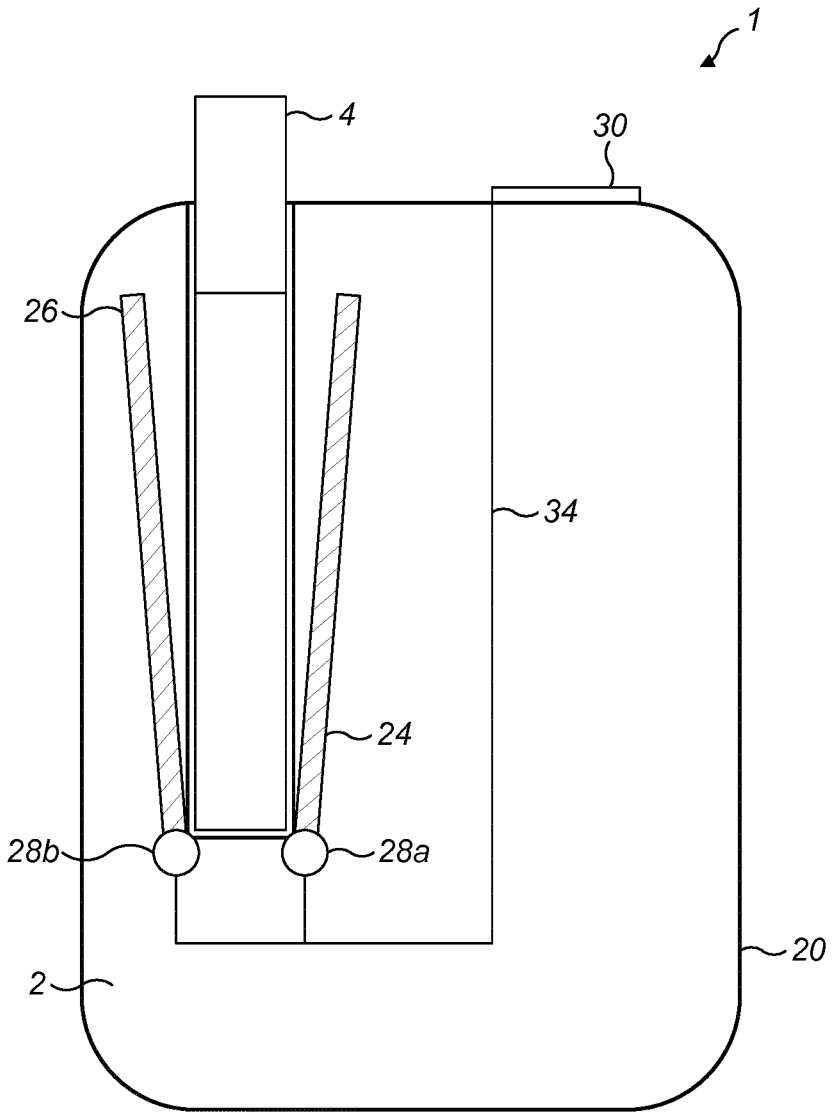
FIG. 4 shows a schematic view of a further example vapour generating device.
Figure 5:
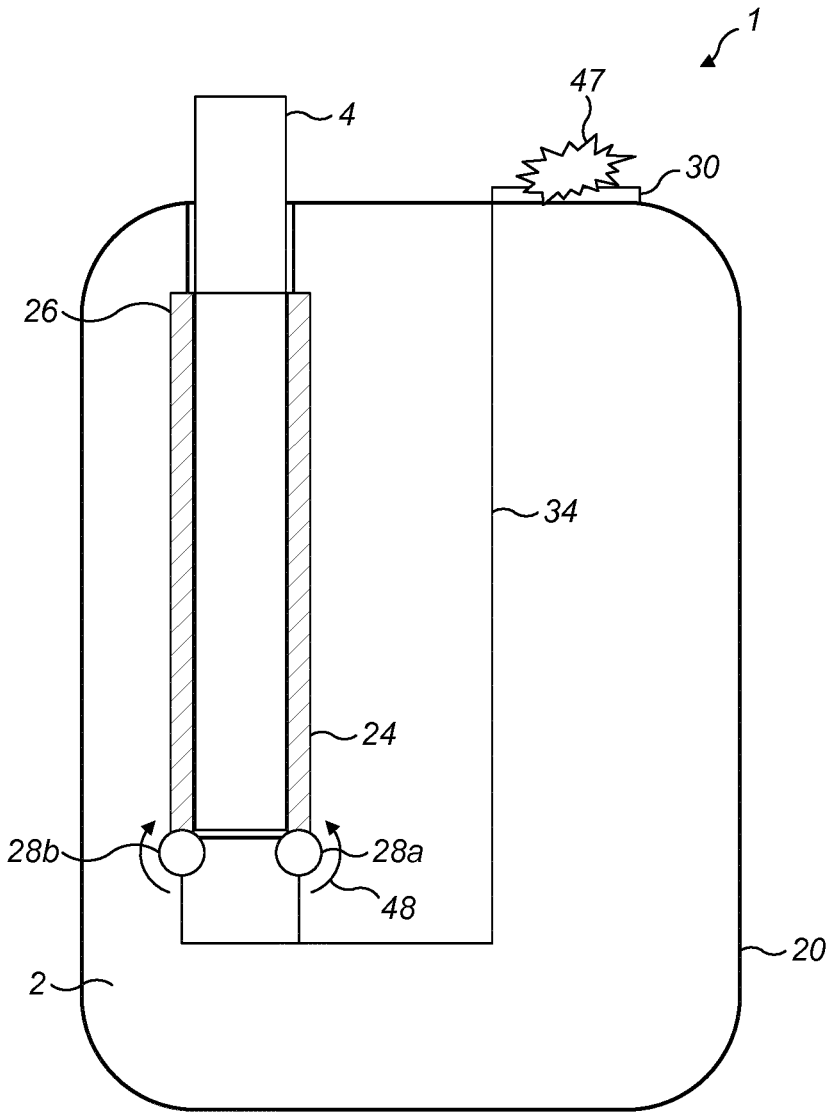
FIG. 5 shows a further schematic view of the further example vapour generating device.

A further example heating assembly 2 is shown in the example vapour generating device generally illustrated at 1 in FIGS. 4 and 5. In this example, the vapour generating substance 3 has the same configuration as the vapour generating substance 3 of the example shown in FIGS. 1 to 3. The heating assembly 2 shown in FIGS. 4 and 5 only has a different switch and movement mechanism from the example heating assembly shown in FIGS. 1 to 3.

In the example heating assembly 2 shown in FIGS. 4 and 5, the movement mechanism is a pair of hinges 28*a*, 28*b*. Each hinge is connected to the end of one of the heaters 24, 26 located at the base of the heating compartment.

There is an electrical connection 34 between the pair of hinges 28*a*, 28*b* and the switch 30 of this example heating assembly 2. In this example, the switch is located on the upper-most surface of the body 20 (as mentioned above, the surface that has the opening in the upper-most surface in communication with the heating compartment). Also, instead of being a push switch, the switch is a touch switch, such as a touch sensor.

FIG. 4 shows the first heater 24 and the second heater 26 in a second position. In this example, this means that the heaters are held at an angle inclined away from each other by the hinges 28*a*, 28*b*. As with the example of FIGS. 1 to 3, without the user operating the switch (and so when the heaters are in this position), no heat is generated by the heaters.

When a user operates the switch 30 by touching the switch, as indicated by flash 47 in FIG. 5, the hinges 28*a*, 28*b* rotate the first heater 24 and second heater 26 towards each other into a first position so that their centre points are closer to each other than when held in the second position. This is indicated by arrows 48. This movement to the first position has the same effect as that set out above in relation to the example of FIGS. 1 to 3. As with that example, in some examples using the configuration shown in FIGS. 4 and 5, a user is able to control the amount of movement of the heaters to control and adjust the amount of pressure and heating applied to the vapour generating substance 3 as desired. This may be achieved by applying different amounts of pressure to the switch in cases in which a pressure-sensitive switch 30 is used, for example.

Figure 6:
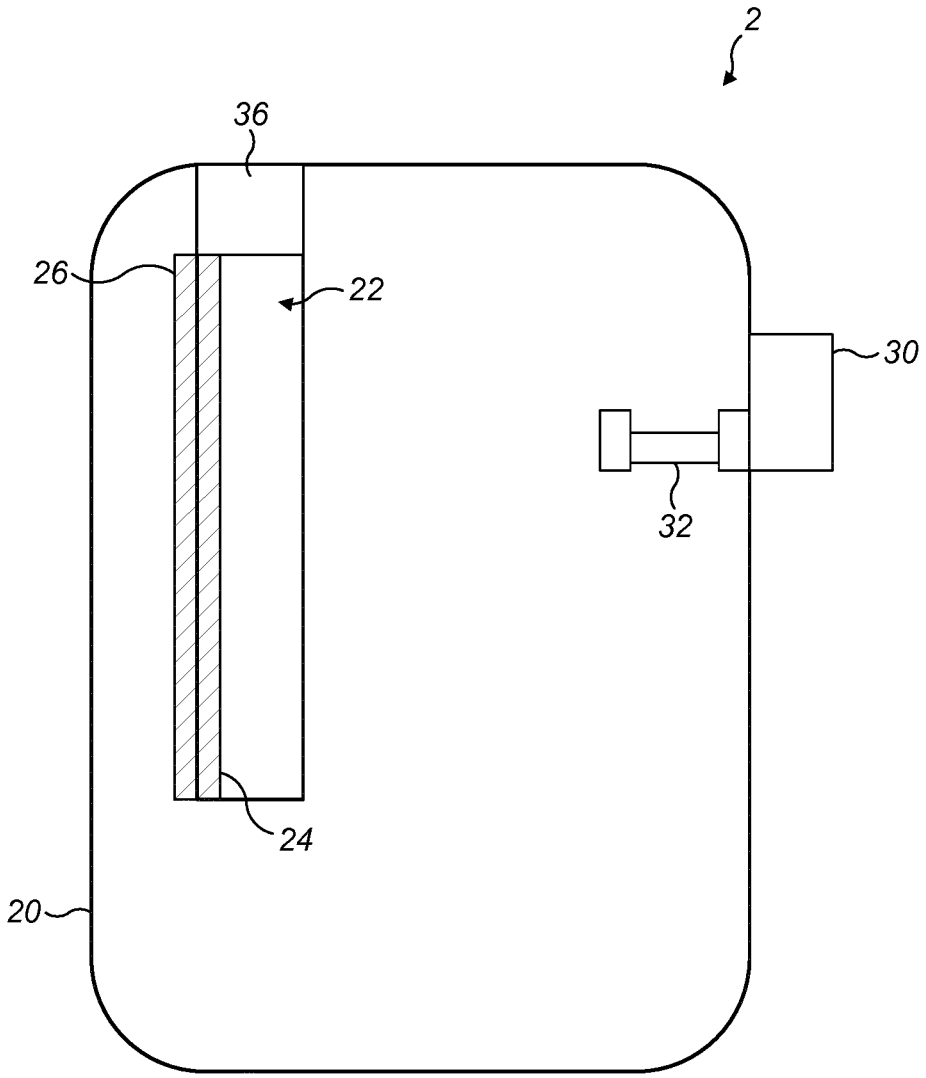
FIG. 6 shows a schematic view of another example vapour generating device.
Figure 7:
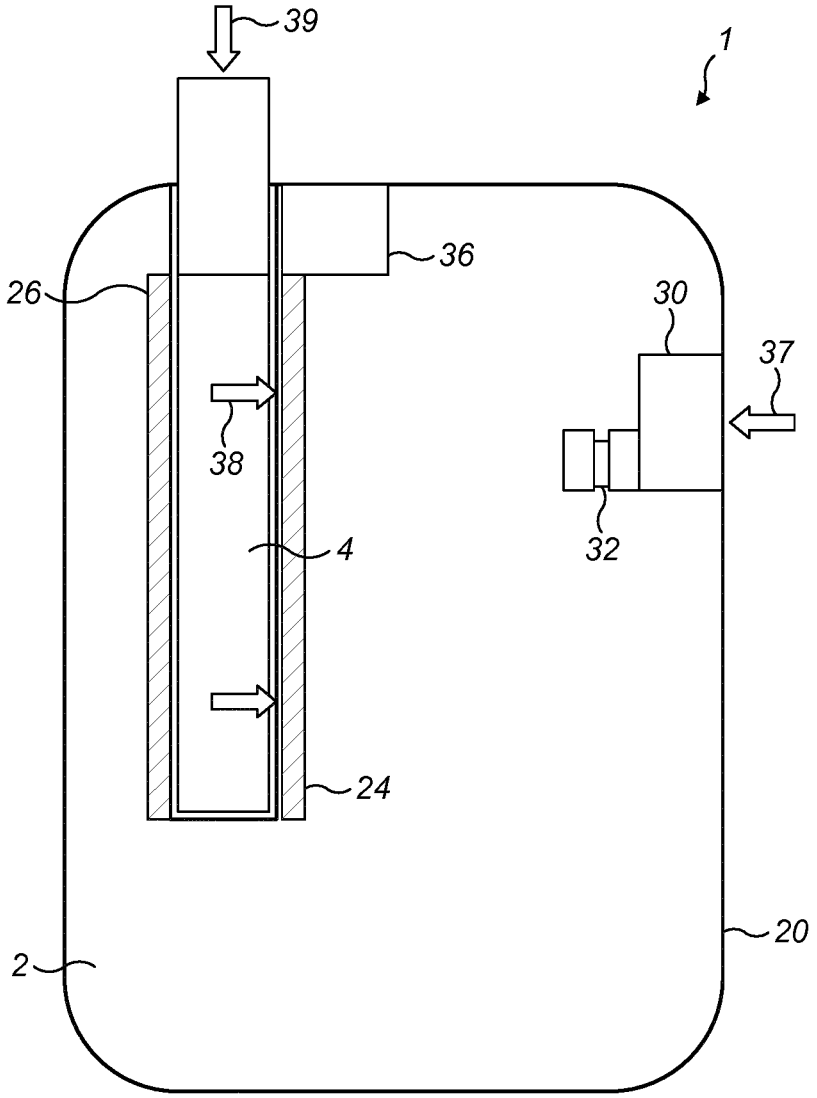
FIG. 7 shows a further schematic view of the example vapour generating device shown in FIG. 6.
Figure 8:
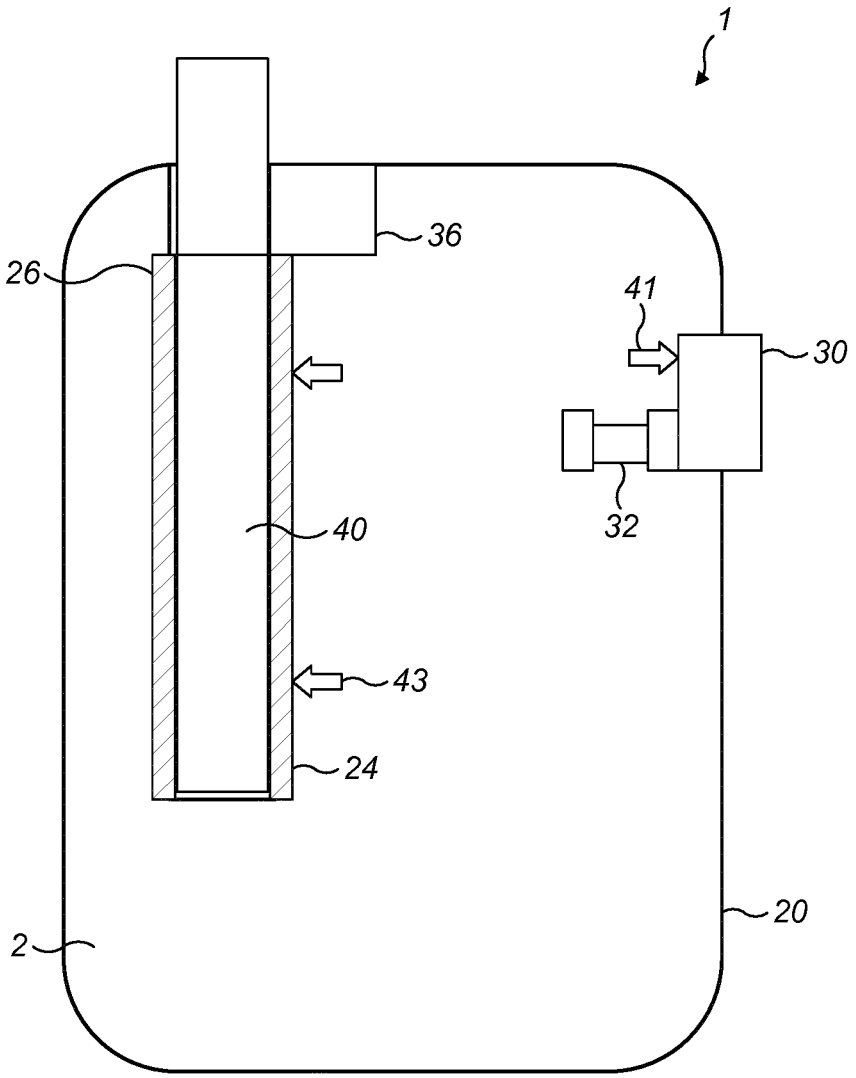
FIG. 8 shows another schematic view of the example vapour generating device shown in FIGS. 6 and 7.

Turning to FIGS. 6 to 8, these show yet another example heating assembly 2. The vapour generating device 1 illustrated in the figures of this example has the same vapour generating substance 3 as in the examples above.

In this example, the heating assembly 2 is similar to the heating assembly in the example shown in FIGS. 1 to 3, but has an additional feature. This is a moveable lid 36 that is able to be moved across the opening in the upper-most surface of the body 20 that is in communication with the heating compartment 22 to open and close the heating compartment.

The lid 36 is connected to the first heater 24. As such, the lid carries out the same movements as the first heater. In order to allow the heating compartment 22 to be closed, the first heater is capable of moving to a third position.

The first heater 24 is shown in the third position in FIG. 6. This shows the first heater located against the second heater 26, there therefore being no separation between the first and second heaters. This can also be described as the distance between the first and second heaters being zero. As can be seen from FIG. 6, this causes the lid 36 to completely cover the opening in the body 20 of the heating assembly in communication with the heating compartment 22.

In this example, the switch 30 is biased by a spring 32, into a position in which it protrudes from the body 20 of the heating assembly 2. This is similar to the arrangement used for the switch in the example shown in FIGS. 1 to 3 and is located at a similar location in the body of the heating assembly. However, in the example shown in FIG. 6, instead of depression of the switch causing movement of the first heater 24 towards the second heater 26 via the movement mechanism (not shown in FIGS. 6 to 8), depression of the switch causes movement of the first heater away from the second heater (i.e. to increase the distance between the two heaters. Although the movement mechanism is not shown, this is able to be achieved, for example, using a gearing system, such as a rack and pinion mechanism with two pinions engaged with each other, each pinion also being engaged with one rack. This allows movement of one rack to induce movement of the other rack, but the direction of movement of the first rack is the reverse of the direction of movement of second rack which the first rack induces the movement in.

This is demonstrated by FIG. 7. This shows the switch 30 in a fully depressed position (indicated by arrow 37). This causes the first heater 24 to move from the third position to the second position (as indicated by arrows 38). This movement of the first heater moves the lid 36 into a recess in the body 20 of the heating assembly to uncover the opening in the body in communication with the heating compartment 22. This allows a vapour generating substance 4 to be inserted into the heating compartment (as indicated by arrow 39).

When the vapour generating substance 4 is inserted into the heating compartment 22, the user operating the switch 30 releases the switch (or applies less force to the switch). This is shown in FIG. 8. This causes the switch to return towards the un-depressed position due to the urging provided by spring 34. This is indicated by arrow 41. This moves the first heater 24 from the second position to the first position, thereby causing the distance between the first heater and the second heater to reduce. This is indicated by arrow 43. The first heater therefore comes into contact and/or applies compression to the tobacco rod 40 of the vapour generating substance 4, holding the vapour generating substance between the first and second heaters. The movement of the first heater of course also causes a corresponding movement of the lid 36.

As with the other examples described above, in this example, the switch 32 is moveable by a user over a switching range. As such, the user is able to adjust the distance between the first and second heaters 24, 26 by operating the switch.

In this example, the generation of heat by the heaters may be triggered by the movement of the switch to the un-depressed position, or on movement of the first heater from the second position to the first position.

Note that in the figures the heaters 24, 26 are schematically illustrated as flat plates, however it will be apparent that alternative configurations of the heaters are possible. For example, the heaters may take a rounded configuration (e.g. being approximately semi-circular in profile if viewed from above) or some other configuration which is more suited to a substantially cylindrical vapour generating substance 4.

Also, there may be more than two heaters, for example 3 heaters which have a round profile when viewed from above, with each heater extending circumferentially about an arc of about ($2\pi/3$) radians (2*Pi/3 radians), or four heaters with each heater extending circumferentially about an arc of about ($2\pi/4$) radians, or n heaters with each heater extending circumferentially about an arc of about ($2\pi/n$) radians, etc. Also the heaters could simply be rods located at approximately equally spaced points around a circumference encircling the heating compartment, etc.

Note that in the described embodiments (other than that illustrated in FIGS. 4 and 5), the switch/button 30 is illustrated as being rigidly connected to one of the heaters. However, in alternative embodiments, the connection between button/switch 30 and heater 24 may include a resilient means such as a spring. In this way, even if a user inadvertently applies excessive pressure to the button/switch, the resulting pressure applied to the vapour generating substance 4 may be damped by the resilient means to avoid crushing the vapour generating substance 4.

In particular, if the button has a maximum displacement position controlled by an abutment surface forming part of the body of the device which is engaged when the button is fully depressed (i.e. maximally displaced), the maximum pressure applied to the vapour generating portion can be controlled/predetermined in dependence upon the properties of the resilient means. That is to say, by carefully choosing the amount of resilience of the resilient means such that it will not apply more than a maximum pressure to the vapour generating portion, a maximum pressure can be selected which will avoid crushing the vapour generating substance.

The invention claimed is:

1. A heating assembly, comprising:

a body defining a heating compartment adapted to receive a vapour generating substance;

at least two heaters between which the vapour generating substance is placeable within the heating compartment in use;

a movement mechanism adapted in use to move at least one of the at least two heaters between a first position and a second position, a distance between the at least two heaters being less when the at least one heater is in the first position than when in the second position, wherein the distance between the at least two heaters when the at least one heater is in the first position being such that a separation of the at least two heaters applies pressure to the vapour generating substance when located in the heating compartment, the movement mechanism being further adapted in use to move the at least one heater to a third position, the distance between the at least two heaters being less when in the third position than when in the first position; and a switch operable by a user of the assembly, the switch being adapted in use to control movement of the at least one heater by the movement mechanism, wherein when the at least one heater is in the third position the switch is inactive.

2. The heating assembly according to claim 1, wherein the switch is configured such that operation by a user causes the movement mechanism to move the at least one heater to the first position.

3. The heating assembly according to claim 1, wherein the switch is configured such that operation by a user causes the movement mechanism to move the at least one heater to the second position.

4. The heating assembly according to claim 1, wherein the switch is located on a face of the body of the assembly having an opening in communication with the heating compartment.

5. The heating assembly according to claim 1, wherein the switch is operable over a switching range, an amount of operation of the switch over the switching range being configured to determine an amount of movement between the first and second positions applied to the at least one heater by the movement mechanism.

6. The heating assembly according to claim 1, wherein the switch is a push switch.

7. The heating assembly according claim 6, wherein pushing of the push switch is configured to move the at least one heater towards the first position.

8. The heating assembly according to claim 1, wherein the switch has a bias to a position in which the at least one heater is held in the second position by the movement mechanism.

9. The heating assembly according to claim 1, wherein the switch and the movement mechanism are a unitary component.

10. The heating assembly according to claim 1, wherein the movement mechanism is a hinge mechanism.

11. The heating assembly according to claim 1, wherein the distance between the at least two heaters when in the third position is zero.

12. A vapour generating device, comprising:

the heating assembly according to claim 1; and a vapour generating substance placeable within the heating compartment of the heating assembly.

13. The heating assembly according to claim 4, wherein the switch is positioned off-centre on said face.

14. The heating assembly according to claim 6, wherein an amount of push applied to the switch corresponding to an amount of movement of the at least one heater by the movement mechanism.

15. The heating assembly according to claim 1, further comprising a lid connected to the at least one heater and arranged to open and close the heating compartment, wherein the lid closes the heating compartment when the at least one heater is in the third position.

16. A heating assembly, comprising:

a body defining a heating compartment adapted to receive a vapour generating substance;

at least two heaters between which the vapour generating substance is placeable within the heating compartment in use;

a movement mechanism adapted in use to move at least one of the at least two heaters between a first position and a second position, a distance between the at least two heaters being less when the at least one heater is in the first position than when in the second position, wherein the distance between the at least two heaters when the at least one heater is in the first position being such that a separation of the at least two heaters applies pressure to the vapour generating substance when located in the heating compartment; and a switch operable by a user of the assembly, the switch being adapted in use to control movement of the at least one heater by the movement mechanism, wherein movement of the switch toward the at least one heater moves the at least one heater away from the other one of the at least two heaters.

17. The heating assembly according to claim 16, wherein the movement mechanism is further adapted in use to move the at least one heater to a third position, the distance between the at least two heaters being less when in the third position than when in the first position.

18. A heating assembly, comprising:

a body defining a heating compartment adapted to receive a vapour generating substance;

at least two heaters between which the vapour generating substance is placeable within the heating compartment in use;

a hinge mechanism adapted in use to move at least one of the at least two heaters between a first position and a second position, a distance between the at least two heaters being less when the at least one heater is in the first position than when in the second position, wherein the distance between the at least two heaters when the at least one heater is in the first position being such that a separation of the at least two heaters applies pressure to the vapour generating substance when located in the heating compartment, a switch operable by a user of the assembly, the switch being adapted in use to control movement of the at least one heater by the hinge mechanism.

* * * * *